US009425508B2

(12) United States Patent
Lai et al.

(10) Patent No.: US 9,425,508 B2
(45) Date of Patent: Aug. 23, 2016

(54) ANTENNA STRUCTURE AND WIRELESS COMMUNICATION DEVICE USING SAME

(71) Applicant: Chiun Mai Communication Systems, Inc., New Taipei (TW)

(72) Inventors: Chih-Hung Lai, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 324 days.

(21) Appl. No.: 14/077,448

(22) Filed: Nov. 12, 2013

(65) Prior Publication Data

US 2014/0354506 A1 Dec. 4, 2014

(30) Foreign Application Priority Data

Jun. 4, 2013 (TW) ..... 102119841 A

(51) Int. Cl.
*H01Q 1/24* (2006.01)
*H01Q 5/00* (2015.01)

(52) U.S. Cl.
CPC ..... *H01Q 5/0058* (2013.01); *H01Q 5/0062* (2013.01); *H01Q 5/0093* (2013.01)

(58) Field of Classification Search
CPC ..... H01Q 5/0058; H01Q 5/0093
USPC ..... 343/853, 893, 702, 700 MS
See application file for complete search history.

(56) References Cited

U.S. PATENT DOCUMENTS

2006/0152419 A1* 7/2006 Sato ..... H01Q 9/26 343/702
2008/0012777 A1 1/2008 Lin et al.
2011/0248895 A1 10/2011 Bungo et al.
2012/0212377 A1* 8/2012 He ..... H01Q 1/2275 343/702
2013/0050038 A1 2/2013 Eom et al.
2013/0135157 A1* 5/2013 Tsou ..... H01Q 1/2266 343/702
2013/0154886 A1* 6/2013 Isohatala ..... H01Q 1/243 343/702
2013/0176178 A1* 7/2013 Chen ..... H01Q 1/243 343/702
2013/0181871 A1* 7/2013 Eom ..... H01Q 1/243 343/702

* cited by examiner

*Primary Examiner* — Hoanganh Le
(74) *Attorney, Agent, or Firm* — ScienBiziP, P.C.

(57) ABSTRACT

An antenna structure includes a feed terminal, a first antenna, and a second antenna. The first antenna includes a first antenna portion connected to the feed terminal, and a second antenna portion connected to the first antenna portion. The second antenna is substantially parallel to the second antenna portion and cooperatively defines a space with the second antenna portion.

20 Claims, 4 Drawing Sheets

ANTENNA STRUCTURE AND WIRELESS COMMUNICATION DEVICE USING SAME

BACKGROUND

1. Technical Field

The present disclosure relates to antenna structures and wireless communication devices, and particularly to an antenna structure for multiband radio signals and a wireless communication device using the same.

2. Description of Related Art

Wireless communication devices, such as mobile phones, are typically compact, so it is important to configure antennas to make full use of an inner space of the wireless communication devices. However, due to limited space inside the wireless communication devices, it is difficult to match an impetus of signals received or transmitted by the antennas, thereby making it difficult to increase a bandwidth of the antennas.

Therefore, there is room for improvement within the art.

BRIEF DESCRIPTION OF THE DRAWINGS

Many aspects of the present antenna structure for multiband radio signals and wireless communication device can be better understood with reference to the following drawings. The components in the various drawings are not necessarily drawn to scale, the emphasis instead being placed upon clearly illustrating the principles of the present antenna structure for multiband radio signals and wireless communication device.

DETAILED DESCRIPTION

Figure 1:
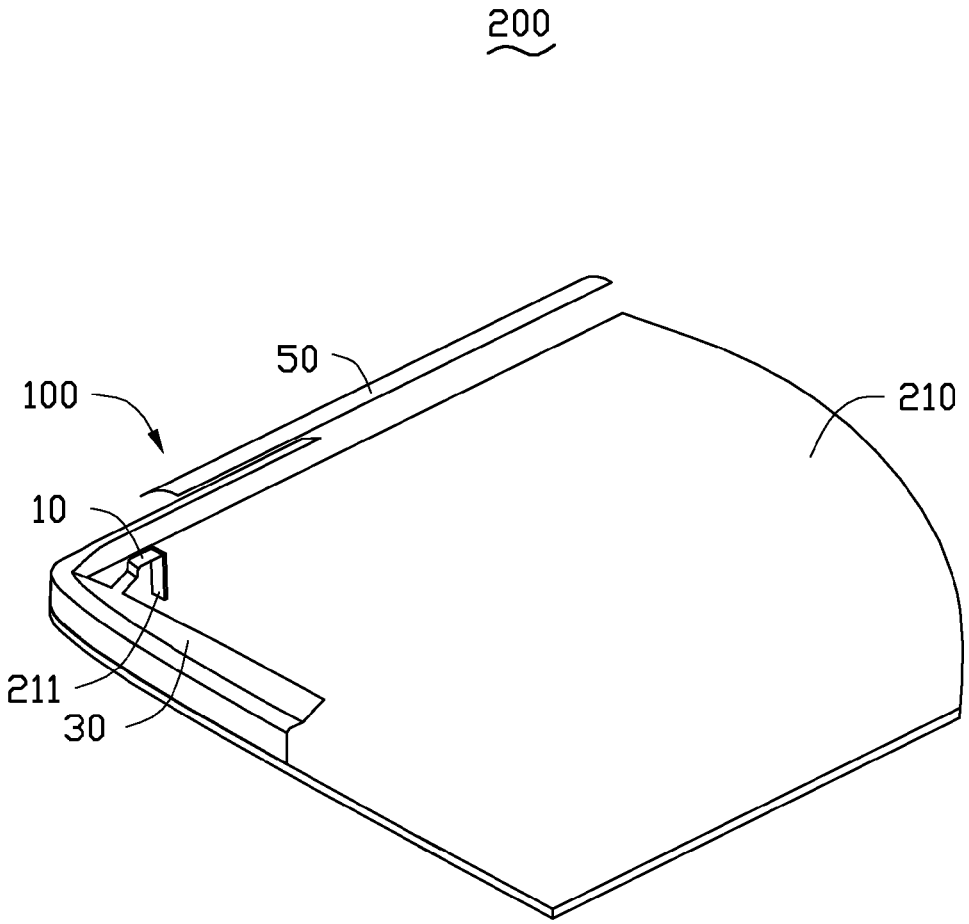
FIG. 1 is a partial schematic view of an antenna structure used in a wireless communication device, according to an exemplary embodiment.

FIG. 1 shows an antenna structure 100 used in a wireless communication device 200, such as a mobile phone or a tablet computer. The wireless communication device 200 further includes a circuit board 210 and a matching circuit 230 (shown in FIG. 3). The circuit board 210 includes a feed portion 211.

In this embodiment, the antenna structure 100 is a monopole antenna. The antenna structure 100 includes a feed terminal 10, a first antenna 30, and a second antenna 50. The feed terminal 10 is electronically connected to the feed portion 211.

Figure 2:
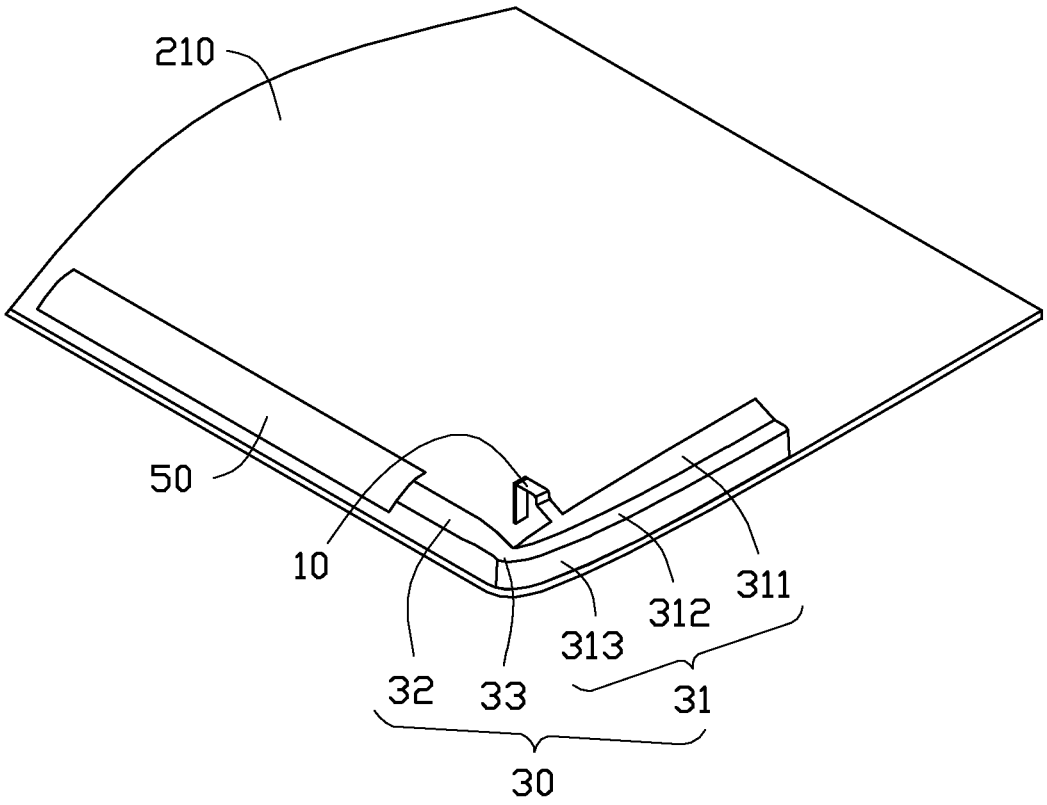
FIG. 2 is similar to FIG. 1, but shown from another angle.

Referring to FIG. 2, the first antenna 30 includes a first antenna portion 31 and a second antenna portion 32 connected to the first antenna portion 31. The first antenna portion 31 includes a first segment 311, a second segment 312, and a third segment 313. A width of the first segment 311 gradually decreases from a distal end of the first antenna portion 31 to a joint portion between the first antenna portion 31 and the second antenna portion 32. The feed terminal 10 is electronically connected to the first segment 311 and is located adjacent to the joint portion between the first antenna portion 31 and the second antenna portion 32. An edge of the second segment 312 is connected to an edge of the first segment 311, and an angle is formed between the connected edges of the first segment 311 and the second segment 312.

In this embodiment, the angle is an obtuse angle. An edge of the third segment 313 is connected to an edge of the second segment 312, and the third segment 313 is substantially perpendicular to the second segment 312. The second segment 312 is connected substantially perpendicularly to the second antenna portion 32, and a joint 33 between the second segment 312 and the second antenna portion 32 is substantially arc-shaped.

Both the first antenna 30 and the second antenna 50 are located at a periphery of the circuit board 210. The second antenna 50 is an arced plate and is located on an outer frame (not shown) of the wireless communication device 200, such that the second antenna 50 is substantially parallel to and cooperatively defines a space (not labeled) with the antenna portion 32. In this embodiment, the space defined between the second antenna 50 and the second antenna portion 32 is about 1 millimeter (mm) thick.

Figure 3:
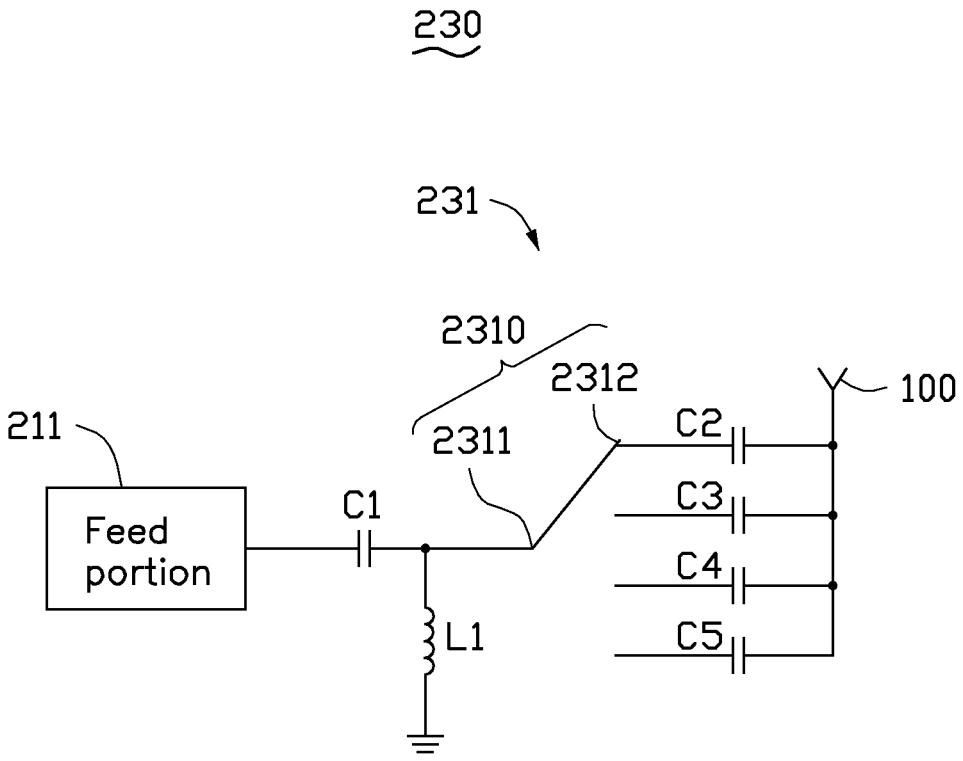
FIG. 3 is a circuit diagram of a first matching module of the wireless communication device.
Figure 4:
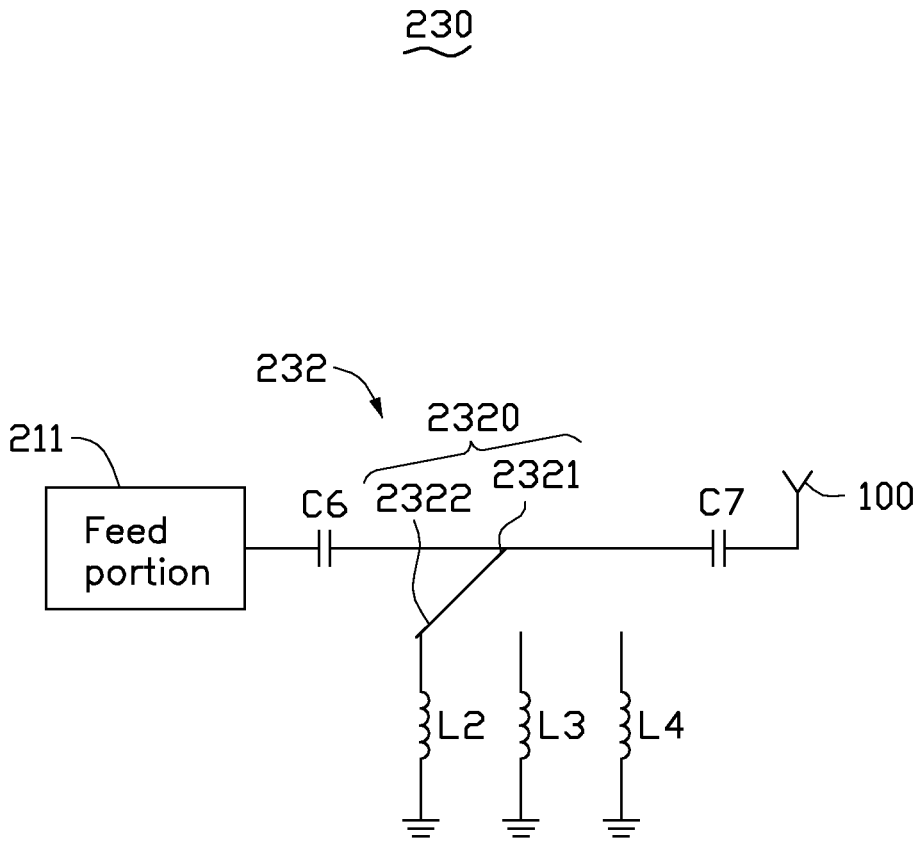
FIG. 4 is a circuit diagram of a second matching module of the wireless communication device.

FIG. 3 and FIG. 4 show a circuit diagram of the matching circuit 230. The matching circuit 230 includes a first matching module 231 and a second matching module 232. Each of the first matching module 231 and the second matching module 232 is electronically connected between the feed portion 211 and the antenna structure 100. In this embodiment, the first matching module 231 is a high frequency matching circuit, and the second matching module 232 is a low frequency matching circuit. The first matching module 231 includes a first capacitor C1, a second capacitor C2, a third capacitor C3, a fourth capacitor C4, a fifth capacitor C5, a first inductor L1, and a first switch 2310. The feed portion 211 is electronically connected to the first capacitor C1, and the first capacitor C1 is grounded by the first inductor L1. The first switch 2310 includes a first end 2311 and a second end 2312. The first end 2311 is connected to a joint between the first capacitor C1 and the first inductor L1. The second capacitor C2, the third capacitor C3, the fourth capacitor C4, and the fifth capacitor C5 are connected in parallel and are electronically connected to the antenna structure 100. The second end 2312 is selectively connected to the second capacitor C2, the third capacitor C3, the fourth capacitor C4, or the fifth capacitor C5.

In this embodiment, a capacitance value of the first capacitor C1 is about 2.5 picofarads (pF), and an inductance value of the first inductor L1 is about 1.7 nanohenries (nH). A capacitance value of the second capacitor C2 is about 4.6 pF, and the second capacitor C2 is configured for performing impedance matching for signals within a Long Term Evolution (LTE) band 3, which has a frequency range from about 1805 megahertz (MHz) to about 1880 MHz. A capacitance value of the third capacitor C3 is about 2.2 pF, and the third capacitor C2 is configured for performing impedance matching for signals within a Wideband Code Division Multiple Access (WCDMA) band 2, which has a frequency range from about 1930 MHz to about 1990 MHz. A capacitance value of the fourth capacitor C4 is about 1.35 pF, and the fourth capacitor C4 is configured for performing impedance matching for signals within an LTE band 4, which has a frequency range from about 2110 MHz to about 2155 MHz. A capacitance value of the fifth capacitor C5 is about 0.6 pF, and the fifth capacitor C5 is configured for performing impedance matching for signals within an LTE band 7, which has a frequency range from about 2620 MHz to about 2690 MHz.

The second matching module 232 includes a sixth capacitor C6, a seventh capacitor C7, a second inductor L2, a third inductor L3, a fourth inductor L4, and a second switch 2320. The second switch 2320 is substantially similar to the first switch 2310 and includes a first end 2321 and a second end 2322. The sixth capacitor C6 and the seventh capacitor C7 are connected in series between the feed portion 211 and the antenna structure 100. The second inductor L2, the third inductor L3, and the fourth inductor L4 are connected in parallel and are directly grounded. The first end 2321 is electronically connected between the sixth capacitor C6 and the seventh capacitor C7. The second end 2322 is selectively connected to the second inductor L2, the third inductor L3, or the fourth inductor L4.

In this embodiment, a capacitance value of the sixth capacitor C6 is about 1 pF, and a capacitance value of the seventh capacitor C7 is about 10 pF. An inductance value of the second inductor L2 is about 14.7 nH, and the second inductor L2 is configured for performing impedance matching for signals within an LTE band 17, which has a frequency band from about 734 MHz to about 746 MHz. An inductance value of the third inductor L3 is about 9.6 nH, and the third inductor L3 is configured for performing impedance matching for signals within a global system for mobile communications (GSM) band 850, which has a frequency from about 869 MHz to about 894 MHz. An inductance value of the fourth inductor L4 is about 8 nH, and the fourth inductor L4 is configured for performing impedance matching for signals within a GSM band 900, which has a frequency band from about 925 MHz to about 960 MHz.

A working process of the wireless communication device 200 includes the following steps: a current from the circuit board 210 is fed into the feed terminal 10 of the antenna structure 100. A portion of the current flows to the first antenna portion 31 to form a high-frequency current path, and another portion of the current flows to the second antenna portion 32. The portion of current that flows to the second antenna portion 32 is electrically coupled to the second antenna 50 to form a low-frequency current path. When the wireless communication device 200 operates in the high frequency band, the first matching module 231 performs impedance matching for signals transmitted or received by the antenna structure 100. Depending on the frequency of signals transmitted or received by the antenna structure 100, the first switch 2310 is selectively connected to the second capacitor C2, the third capacitor C3, the fourth capacitor C4, or the fifth capacitor C5. For example, if the frequency of the signals transmitted or received by the antenna structure 100 is within the LTE band 3 (1805 MHz-1880 MHz), the first switch 2310 is electronically connected to the second capacitor C2.

When the wireless communication device 200 operates in the low frequency band, the second matching module 232 performs impedance matching for signals transmitted or received by the antenna structure 100. Depending on the frequency of signals transmitted or received by the antenna structure 100, the second switch 2320 is selectively connected to the second inductor L2, the third inductor L3, or the fourth inductor L4. For example, if the frequency of the signals received by the antenna structure 100 is within the LTE band 17 (734 MHz-746 MHz), the second switch 2320 is electronically connected to the second inductor L2.

The first antenna 30 and the second antenna 50 make full use of an inner space of the wireless communication device 200. The matching circuit 230 performs impedance matching for signals transmitted or received by the antenna structure 100 to increase a bandwidth of the antenna structure 100.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An antenna structure comprising:

a feed terminal;

a first antenna comprising a first antenna portion connected to the feed terminal, and a second antenna portion connected to the first antenna portion; and a second antenna;

wherein the second antenna is parallel to the second antenna portion and cooperatively defines a space with the second antenna portion; the first antenna portion comprises a first segment, a second segment, and a third segment an edge of the second segment is connected to an edge of the first segment and an angle is formed between the connected edges of the first segment and the second segment; the third segment is connected to the second segment and is perpendicular to the second segment.

2. The antenna structure as claimed in claim 1, wherein a width of the first segment gradually decreases from a distal end of the first antenna portion to a joint portion between the first antenna portion and the second antenna portion.

3. The antenna structure as claimed in claim 2, wherein the feed terminal is electronically connected to the first segment and is located adjacent to the joint portion between the first antenna portion and the second antenna portion.

4. The antenna structure as claimed in claim 1, wherein the angle is an obtuse angle.

5. The antenna structure as claimed in claim 1, wherein the second segment is perpendicularly connected to the second antenna portion, and a joint between the second segment and the second antenna portion is arc-shaped.

6. The antenna structure as claimed in claim 1, wherein an interval between the second antenna and the second antenna portion is about 1 millimeter.

7. The antenna structure as claimed in claim 1, wherein the second antenna is an arc plate.

8. A wireless communication device, comprising:

a circuit board comprising a feed portion;

an antenna structure comprising a feed terminal, a first antenna and a second antenna, the first antenna comprising a first antenna portion connected to the feed terminal, and a second antenna portion connected to the first antenna portion; the first antenna portion comprising a first segment, a second segment, and a third segment an edge of the second segment connected to an edge of the first segment and an angle formed between the connected edges of the first segment and the second segment the third segment connected to the second segment and perpendicular to the second segment, the second antenna being parallel to the second antenna portion and cooperatively defining a space with the second antenna portion; and a matching circuit electronically connected between the feed portion and the antenna structure.

9. The wireless communication device as claimed in claim 8, wherein the matching circuit comprises a first matching module, the first matching module comprises a first capacitor and a first inductor, the feed portion is electronically connected to the first capacitor, and the first capacitor is grounded by the first inductor.

10. The wireless communication device as claimed in claim 9, wherein the first matching module further comprises a second capacitor, a third capacitor, a fourth capacitor, a fifth capacitor and a first switch; the second capacitor, the third capacitor, the fourth capacitor, and the fifth capacitor are connected in parallel and are electronically connected to the antenna structure; the first switch comprises a first end and a second end, the first end of the first switch is connected between the first capacitor and the first inductor, the second end of the first switch is selectively connected to the second capacitor, the third capacitor, the fourth capacitor, or the fifth capacitor.

11. The wireless communication device as claimed in claim 10, wherein the matching circuit further comprises a second matching module, the second matching module comprises a sixth capacitor, and a seventh capacitor, the feed portion is electronically connected to the sixth capacitor, and the sixth capacitor is electronically connected to the antenna structure by the seventh capacitor.

12. The wireless communication device as claimed in claim 11, wherein the second matching module further comprises a second inductor, a third inductor, a fourth inductor, and a second switch; the second inductor, the third inductor, and the fourth inductor are connected in parallel and are grounded; the second switch comprises a first end and a second end, the first end of the second switch is electronically connected between the sixth capacitor and the seventh capacitor, the second end is selectively connected to the second inductor, the third inductor, or the fourth inductor.

13. The wireless communication device as claimed in claim 8, wherein both the first antenna and the second antenna are located at a periphery of the circuit board.

14. The wireless communication device as claimed in claim 8, wherein a width of the first segment gradually decreases from a distal end of the first antenna portion to a joint portion between the first antenna portion and the second antenna portion.

15. The wireless communication device as claimed in claim 8, wherein the angle is an obtuse angle.

16. The wireless communication device as claimed in claim 8, wherein the second segment is perpendicularly connected to the second antenna portion, and a joint between the second segment and the second antenna portion is arc-shaped.

17. The wireless communication device as claimed in claim 8, wherein an interval between the second antenna and the second antenna portion is about 1 millimeter.

18. The wireless communication device as claimed in claim 8, wherein the second antenna is an arc plate.

19. A wireless communication device, comprising:

a circuit board comprising a feed portion;

an antenna structure comprising a feed terminal, a first antenna and a second antenna, the first antenna comprising a first antenna portion connected to the feed terminal, and a second antenna portion connected to the first antenna portion, the second antenna being parallel to the second antenna portion and cooperatively defining a space with the second antenna portion; and a matching circuit electronically connected between the feed portion and the antenna structure;

wherein the matching circuit comprises a first matching module, the first matching module comprises a first capacitor, a first inductor, a second capacitor, a third capacitor, a fourth capacitor, a fifth capacitor, and a first switch; the feed portion is electronically connected to the first capacitor, the first capacitor is grounded by the first inductor; the second capacitor, the third capacitor, the fourth capacitor, and the fifth capacitor are connected in parallel and are electronically connected to the antenna structure; the first switch comprises a first end and a second end, the first end of the first switch is connected between the first capacitor and the first inductor, the second end of the first switch is selectively connected to the second capacitor, the third capacitor, the fourth capacitor, or the fifth capacitor.

20. The wireless communication device as claimed in claim 19, wherein the matching circuit further comprises a second matching module, the second matching module comprises a sixth capacitor, a seventh capacitor, a second inductor, a third inductor, a fourth inductor, and a second switch; the feed portion is electronically connected to the sixth capacitor, the sixth capacitor is electronically connected to the antenna structure by the seventh capacitor; the second inductor, the third inductor, and the fourth inductor are connected in parallel and are grounded; the second switch comprises a first end and a second end, the first end of the second switch is electronically connected between the sixth capacitor and the seventh capacitor, the second end is selectively connected to the second inductor, the third inductor, or the fourth inductor.

* * * * *